US008346148B2

(12) United States Patent
Yonekawa et al.

(10) Patent No.: US 8,346,148 B2
(45) Date of Patent: Jan. 1, 2013

(54) FIXING DEVICE AND IMAGE FORMING APPARATUS

(75) Inventors: Noboru Yonekawa, Toyohashi (JP); Mamoru Fukaya, Nagoya (JP); Naoki Yamamoto, Toyohashi (JP); Toru Hayase, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 11 days.

(21) Appl. No.: 13/111,093

(22) Filed: May 19, 2011

(65) Prior Publication Data

US 2011/0299900 A1 Dec. 8, 2011

(30) Foreign Application Priority Data

Jun. 3, 2010 (JP) ..... 2010-127575

(51) Int. Cl.
*G03G 15/20* (2006.01)

(52) U.S. Cl. ..... 399/329

(58) Field of Classification Search ..... 399/328, 399/329; 219/216, 469–471
See application file for complete search history.

(56) References Cited

U.S. PATENT DOCUMENTS 5,257,078 A * 10/1993 Kuroda ..... 399/329

FOREIGN PATENT DOCUMENTS

| | | |
|---|---|---|
| JP | 06-083224 | 3/1994 |
| JP | 07-244441 | 9/1995 |
| JP | 07-281549 | 10/1995 |
| JP | 08-335000 | 12/1996 |
| JP | 09-114295 | 5/1997 |
| JP | 09-146400 | 6/1997 |
| JP | 09-305050 | 11/1997 |
| JP | 11-143286 | 5/1999 |
| JP | 2001-155844 | 6/2001 |
| JP | 2006-049088 | 2/2006 |
| JP | 2007-134083 | 5/2007 |
| JP | 2007-272223 | 10/2007 |
| JP | 2009-251132 | 10/2008 |
| JP | 2009-109997 | 5/2009 |
| JP | 2009-157108 | 7/2009 |
| WO | WO/91/10336 | 11/1991 |

OTHER PUBLICATIONS

Japanese Decision to Grant Patent mailed Apr. 17, 2012, directed to counterpart Japanese Application No. 2010-127575; 5 pages.

* cited by examiner

*Primary Examiner* — Susan Lee
(74) *Attorney, Agent, or Firm* — Morrison & Foerster LLP

(57) ABSTRACT

A fixing device thermally fixes an unfixed image on a recording sheet by passing the recording sheet through a fixing nip. The fixing device has: a heat-generating endless belt; a first pressure member inside a running path of the endless belt; a second pressure member pressing the endless belt against the first pressure member from outside the running path to form the fixing nip, and a pair of power feeders. The endless belt includes: a circumferential resistive heat layer that generates heat upon receiving electric current; and a first electrode and a second electrode flanking a sheet passing area of the circumferential surface of the endless belt. Each electrode is composed of a pair of electrode layers, one on the inner and another on the outer circumferential surface of the resistive heat layer. Each power feeder is in contact with both the electrode layers of a different electrode.

10 Claims, 9 Drawing Sheets

FIXING DEVICE AND IMAGE FORMING APPARATUS

This application is based on an application No. 2010-127575 filed in Japan, the contents of which are hereby incorporated by reference.

BACKGROUND OF THE INVENTION (1) Field of the Invention

The present invention relates to a fixing device and an image forming apparatus including the fixing device. In particular, the present invention relates to a technology applicable to a fixing device to extend the life of a fixing belt that is included in the fixing device and that has a resistive heat layer and electrode layers for feeding power to the resistive heat layer.

(2) Description of the Related Art

As disclosed, for example, in JP patent application publication No. 2007-272223, some conventional image forming apparatuses (such as printers) employ a fixing device that generates heat upon receiving electric current directly applied to a fixing belt that includes a resistive heat layer.

Such a fixing device provides an advantage of energy savings over a fixing device employing a halogen heater as a heat source.

FIG. 9 is a sectional view of a fixing belt included in a fixing device having a resistive heat layer.

As shown in the figure, a fixing belt 500 includes a reinforcing layer 555 and a resistive heat layer 556 laminated on the reinforcing layer 555.

On the outer circumferential surface of the resistive heat layer 556, a pair of electrode layers 559 are disposed each along an edge of the resistive heat layer 556. The electrode layers 559 are made of metal material and act as electrodes for receiving power from an external power supply.

On the outer circumferential surface of the resistive heat layer 556, in addition, a releasing layer 557 is disposed between the pair of electrode layers 559 for helping a recording sheet to be smoothly released.

Note that the resistive heat layer 556 is made of a material having high electrical resistance and therefore generates heat due to Joule heating in response to the passage of electric current.

With the above configuration, by placing the electrode layers 559 into contact with a pair of power feeders 570 connected to an external AC power source 580, a potential difference is produced across the edges of the resistive heat layer 556 to cause an electric current to pass through the resistive heat layer 556.

As a result, the resistive heat layer 556 generates heat, which is used for thermally fusing an image onto a recording sheet.

Unfortunately, the fixing belt 500 having the above configuration has been found to cause local overheating as a result of the passage of electric current for a long period of time. The overheating occurs locally at around contact portions 560 where the edge of each electrode layer 559 closer toward the releasing layer 557 contacts the resistive heat layer 556.

Such local overheating accelerates deterioration of the heated portions as compared with other portions, which ends up reducing the life of the fixing belt 500.

The following are believed to be the causes of the local overheating.

That is, due to the tendency to flow into where the resistance is lower, the electric current fed to each electrode layer 559 from a corresponding one of the power feeders 570 flows into the resistive heat layer 556 through a portion closer to the other electrode layer 559.

As a result, the electric current flowing between each electrode layer 559 and the resistive heat layer 556 concentrates mainly at the contact portions 560 where the edge of each electrode layer 559 closer toward the releasing layer 557 contacts the resistive heat layer 556.

The electric current flowing into the resistive heat layer 556 locally through each contact portion 560 is then distributed in the thickness direction of the resistive heat layer 556 and concentrates again at around the other contact portion 560.

As a result, the current density reaches the maximum at the contact portions 560, which results in overheating at the corresponding portions of the resistive heat layer 556.

SUMMARY OF THE INVENTION

The present invention is made in view of the above problems and aims to extend the life of a fixing belt included in a fixing device and in an image forming apparatus using a resistance heat generation mechanism.

In order to achieve the above aim, a first aspect of the present invention provides a fixing device for thermally fixing an unfixed image formed on a recording sheet by passing the recording sheet through a fixing nip. The fixing device has: a heat-generating endless belt having, on a circumferential surface thereof, a sheet passing area through which the recording sheet passes; a first pressure member disposed inside a running path of the heat-generating endless belt; a second pressure member disposed to press the heat-generating endless belt against the first pressure member from outside the running path to form the fixing nip, and a pair of power feeders. The heat-generating endless belt includes: a circumferential resistive heat layer that generates heat upon having electric current applied thereto; and a first electrode and a second electrode that receive electric current, the first and second electrodes flanking the sheet passing area, Each of the first and second electrodes is composed of a pair of electrode layers, one disposed on an inner circumferential surface of the resistive heat layer and another disposed on an outer circumferential surface of the resistive heat layer. One of the power feeders is disposed in contact with both the electrode layers of the first electrode to feed power thereto. Another one of the power feeders is disposed in contact with both the electrode layers of the second electrode to feed power thereto.

In order to achieve the above aim, a second aspect of the present invention provides an image forming apparatus including a fixing device for thermally fixing an unfixed image formed on a recording sheet by passing the recording sheet through a fixing nip. The fixing device has: a heat-generating endless belt having, on a circumferential surface thereof, a sheet passing area through which the recording sheet passes; a first pressure member disposed inside a running path of the heat-generating endless belt; a second pressure member disposed to press the heat-generating endless belt against the first pressure member from outside the running path to form the fixing nip, and a pair of power feeders. The heat-generating endless belt includes: a circumferential resistive heat layer that generates heat upon having electric current applied thereto; and a first electrode and a second electrode that receive electric current, the first and second electrodes flanking the sheet passing area, Each of the first and second electrodes is composed of a pair of electrode layers, one disposed on an inner circumferential surface of the resistive heat layer and another disposed on an outer circumferential surface of the resistive heat layer. One of the power feeders is disposed in contact with both the electrode layers of the first electrode to feed power thereto. Another one of the power feeders is disposed in contact with both the electrode layers of the second electrode to feed power thereto.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an embodiment in which an image forming apparatus of the present invention is applied to a tandem-type digital color printer (hereinafter, simply "printer").

Figure 1:
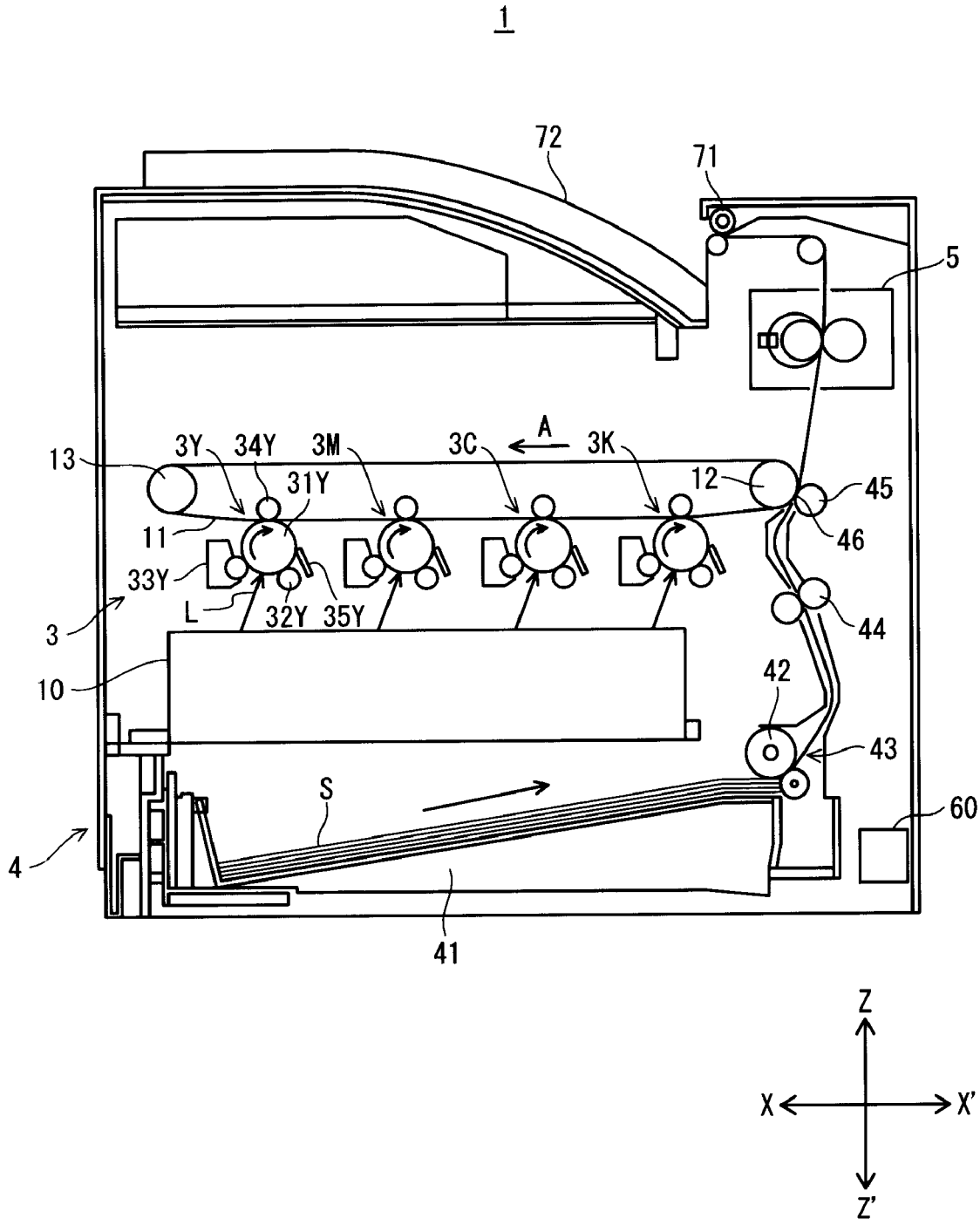
FIG. 1 is a schematic cross-sectional view showing the entire structure of a printer according to an embodiment of the present invention.

FIG. 1 is a schematic cross-sectional view showing the entire structure of a printer 1 according to the embodiment.

As shown in FIG. 1, the printer 1 includes an image processer 3, a sheet feeder 4, a fixing unit 5, and a controller 60. The printer 1 may be connected to a network (such as LAN) to receive instructions for executing a print job from an external terminal device (not shown). Upon receipt of such an instruction, the printer 1 forms toner images of the respective colors of yellow, magenta, cyan, and black, and sequentially transfers the toner images to form a full-color image.

In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

<Image Processer>

The image processer 3 includes image creating units 3Y, 3M, 3C, and 3K respectively corresponding to the colors Y, M, C, and K, and also includes an optical unit 10 and an intermediate transfer belt 11.

The image creating unit 3Y includes a photoconductive drum 31Y and also includes a charger 32Y, a developer 33Y, a first transfer roller 34Y, and a cleaner 35Y, which are disposed about the photoconductive drum 31Y. The cleaner 35Y is provided for cleaning the photoconductive drum 31Y. The image creating unit 3Y forms a yellow toner image on the photoconductive drum 31Y.

The intermediate transfer belt 11 is an endless belt wound around a drive roller 12 and a passive roller 13 in taut condition to rotatably run in the direction indicated by the arrow "A".

The optical unit 10 includes a light emitting element, such as a laser diode. In accordance with drive signals from the controller 60, the optical unit 10 emits a laser beam L to sequentially scan the surfaces of the photoconductive drums 31Y-31K to form images of the respective colors Y, M, C, and K.

Then, the electrostatic latent images are sequentially developed by the respective developers 33Y-33K to form toner images of colors Y-K on the photoconductive drum 31Y-31K with appropriately adjusted timing. As a result, the process of first transfer is carried out to layer the transferred images on precisely the same position on the surface of the intermediate transfer belt 11.

By the action of the electrostatic force imposed by the first transfer rollers 34Y-34K, the toner images of the respective colors are sequentially transferred onto the intermediate transfer belt 11 to form a full color toner image, which is then carried to a second transfer position 46 by the intermediate transfer belt 11.

The sheet feeder 4 includes: a paper feed cassette 41 for storing recording sheets S; a pickup roller 42 that picks up a recording sheet S from the paper feed cassette 41 one sheet at a time and feeds the recording sheet S onto a transport path 43; and a pair of timing rollers 44 that adjusts the timing to transport the fed recording sheet S to a second transfer position 46.

The recording sheet S having passed through the second transfer position 46 is transported to the fixing unit 5 where heat and pressure is applied to the recording sheet S, so that the toner image (unfixed image) on the recording sheet S is fused and fixed. The recording sheet S then passes between a pair of ejection rollers 71 to be ejected onto an exit tray 72.

<Fixing Unit>

Figure 2:
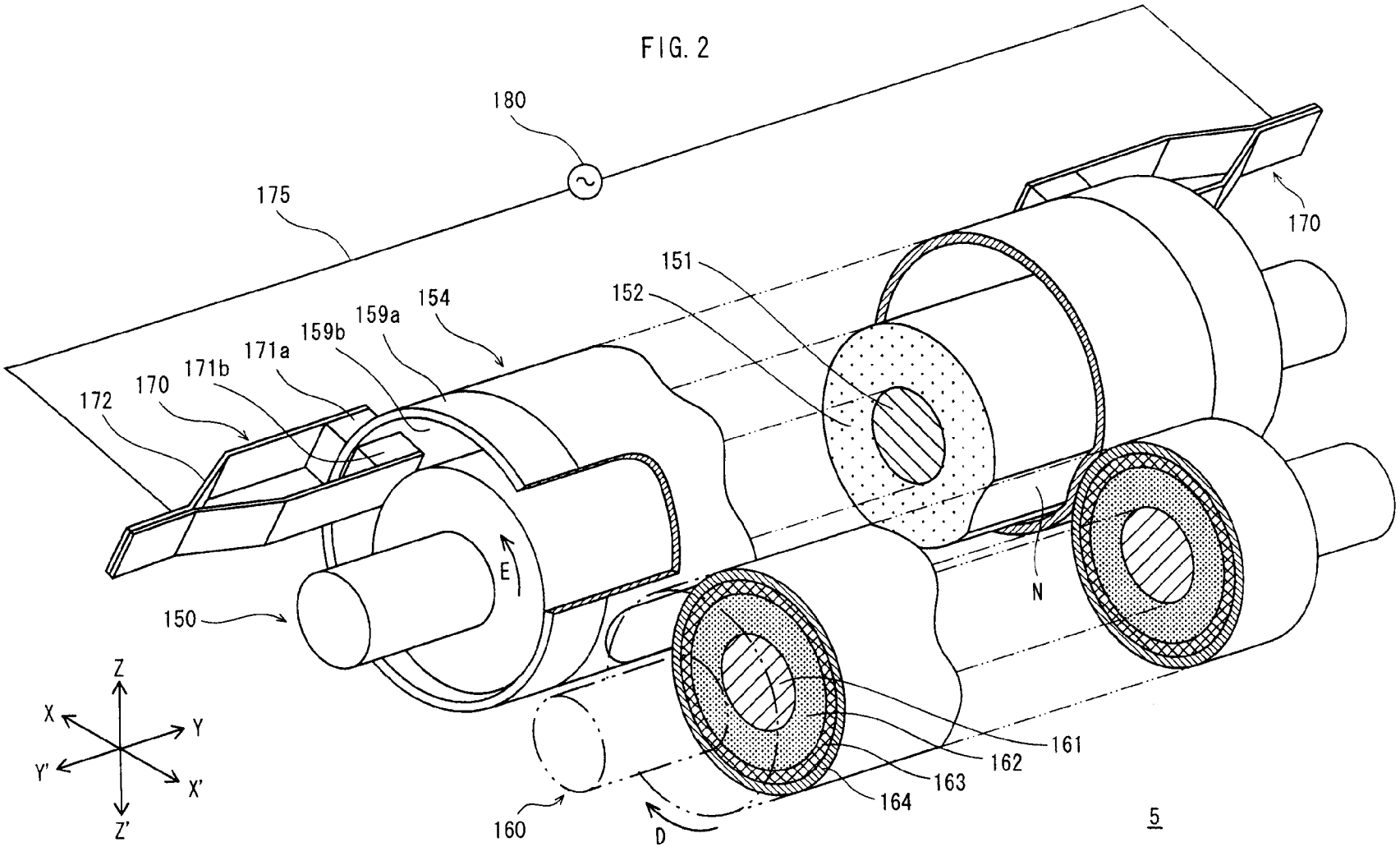
FIG. 2 is a partially broken perspective view of a fixing device according to the embodiment of the present invention.
Figure 3:
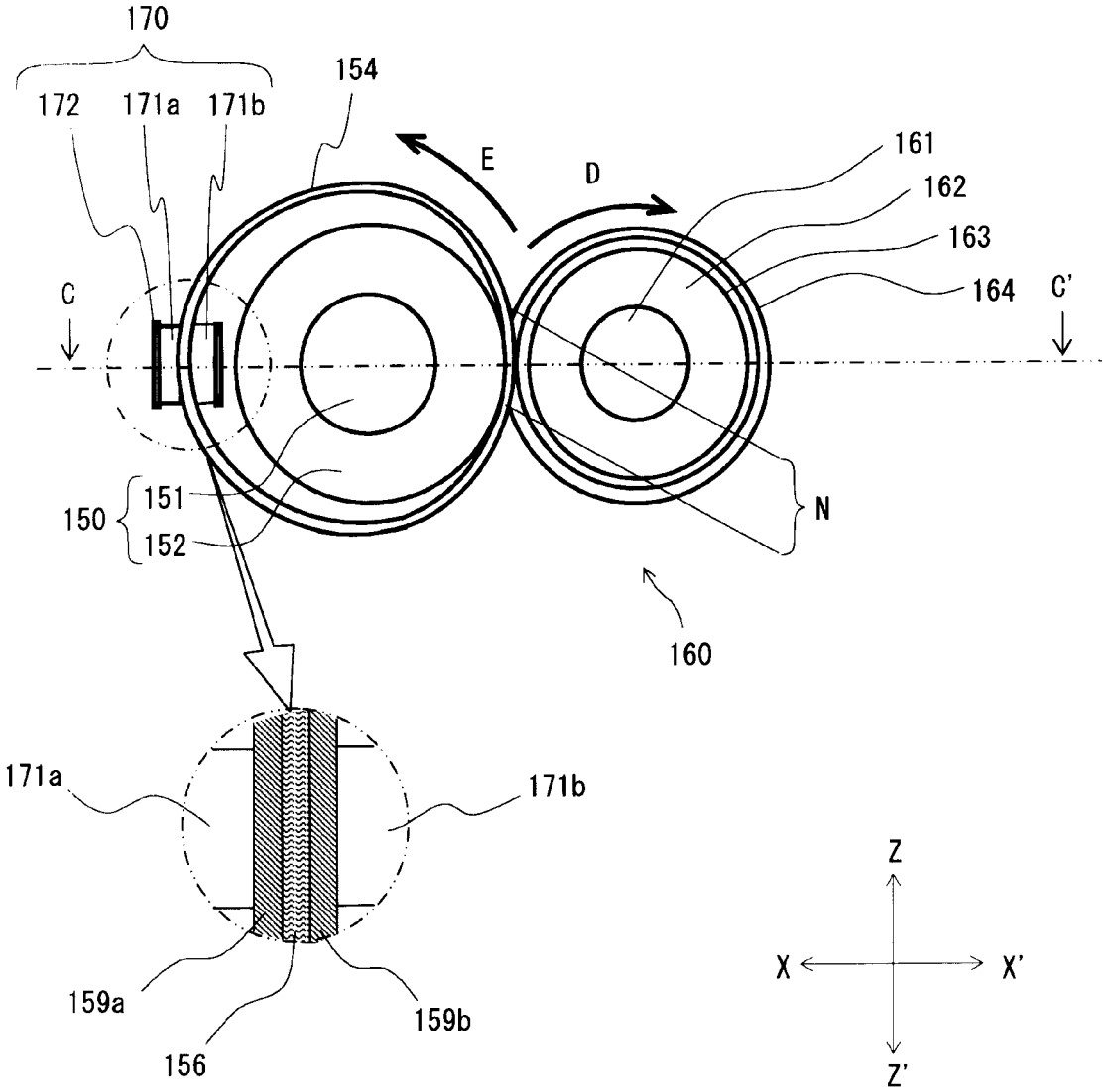
FIG. 3 is a side view of the fixing device according to the embodiment of the present invention.

FIG. 2 is a partially broken, perspective view of the fixing unit 5, whereas FIG. 3 is a side view of the fixing unit 5.

As shown in FIG. 2, the fixing unit 5 includes a fixing belt 154, a pressure roller 150, a pressing roller 160, and a pair of power feeders 170.

The pressure roller 150 is disposed inside the running path of the fixing belt 154 with play (i.e., clearance) relatively to the fixing belt 154.

On the other hand, the pressing roller 160 is disposed outside the running path of the fixing belt 154 and driven by a driving mechanism (not shown) to run in the direction indicated by the arrow D, while pressurizing the pressure roller 150 from outside via the fixing belt 154.

This causes the fixing belt 154 and the pressure roller 150 to rotate passively in the direction indicated by the arrow E, thereby forming a fixing nip N between the pressure roller 150 and the fixing belt 154.

When the recording sheet (not shown) passes through the fixing nip N while the fixing nip N is maintained at a target temperature, heat and pressure is applied to the recording sheet to fuse the unfixed toner image formed on the recording sheet.

The following describes in detail the structure of the fixing unit 5.

<Pressure Roller>

The pressure roller 150 is composed of a cylindrical roller shaft 151 of long dimension and an elastic layer 152 covering the circumferential surface of the roller shaft 151.

The roller shaft 151 is made of, for example, aluminum, iron, or stainless and in the shape of a cylinder that measures approximately 18 mm in outer diameter. The roller shaft 151 is rotatably supported with its axial ends received in bearings that are provided on the main frame (not shown) of the fixing unit 5.

The elastic layer 152 is made of a highly heat-resistant and heat-insulating foamed elastic material, such as a silicone rubber or a fluorine-containing rubber. The thickness of the elastic layer 152 is in the range from 1 mm to 20 mm. Thus the outer diameter of the pressure roller 150 falls in the range from 20 mm to 100 mm. In the present example, the outer diameter of the pressure roller 150 is 5 mm.

The elastic layer 152 is 350 mm long in the Y-axis direction.

<Pressing Roller>

The pressing roller 160 includes a roller shaft 161 and also includes an elastic layer 162, an adhesive layer 163, and a releasing layer 164 that are laminated on the outer circumferential surface of the roller shaft 161 in the stated order.

The roller shaft 161 is, for example, a solid aluminum shaft having an outer diameter of approximately 30 mm and rotated by a driving mechanism (not shown).

The elastic layer 162 is a tubular-shaped silicone rubber which measures 310 mm in the Y-axis direction.

Alternatively to the silicone rubber, the elastic layer 162 may be made of a highly heat-resistant material, such as a fluorine-containing rubber.

The thickness of the elastic layer 162 is preferably in the range from 1 mm to 20 mm, and is 2 mm in the present example.

The releasing layer 164 is formed from a fluorine-containing resin such as polytetrafluoroethylene (PTFE) or tetrafluoroethylene perfluoroalkoxy vinyl ether copolymer (PFA) to have a thickness in the range from 10 μm to 50 μm.

The adhesive layer 163 is made by, for example, applying an adhesive, such as a silicone adhesive, to the surface of the elastic layer 162.

Note that the elastic layer 162, the adhesive layer 163, and the releasing layer 164 are all 310 mm long in the Y-axis direction, which is of course longer than the maximum paper width of any usable recording sheet.

<Power Feeders>

The power feeders 170 are electrically connected to an external power supply 180 via lead wires 175, and disposed in contact with electrode layers 159*a* and 159*b* (which will be described later) of the fixing belt 154 to feed power to the electrode layers 159*a* and 159*b*.

The power supply 180 is, for example, a 100 V/50 or 60 Hz commercial power supply.

A relay switch (not shown) is provided in an inserted condition in the lead wires 175. The relay switch goes ON and OFF in accordance with instructions from the controller 60 to allow the electric current to pass through as necessary.

More specifically, each power feeder 170 is composed of brush portions 171*a* and 171*b* and a leaf spring 172.

Each of the brush portions 171*a* and 171*b* is a so-called carbon brush, which is made of a lubricating and conductive material, such as copper-graphite or carbon-graphite and has the shape of a rectangular solid that measures, for example, 12 mm in the Y-axis direction, 10 mm in the direction perpendicular to the Y-axis direction, and 15 mm in thickness.

Each leaf spring 172 is a Y-shaped plate member made from a conductive and resilient material, such as phosphor bronze or stainless. The leaf spring 172 is fixed to an insulator on the main frame (not shown) of the printer 1 at a portion corresponding to the bottom of the Y shape. In addition, the leaf spring 172 is bonded, by e.g. an adhesive having electrical conductivity, to the brushes 171*a* and 171*b* at two portions corresponding to the ends of forked branches of the Y shape.

As shown in FIG. 3, the leaf spring 172 sandwiches an edge of the fixing belt 154 via the brushes 171*a* and 171*b*, so that the brushes 171*a* and 171*b* are pressed against the electrode layers 159*a* and 159*b*, respectively.

<Fixing Belt>

Figure 4:
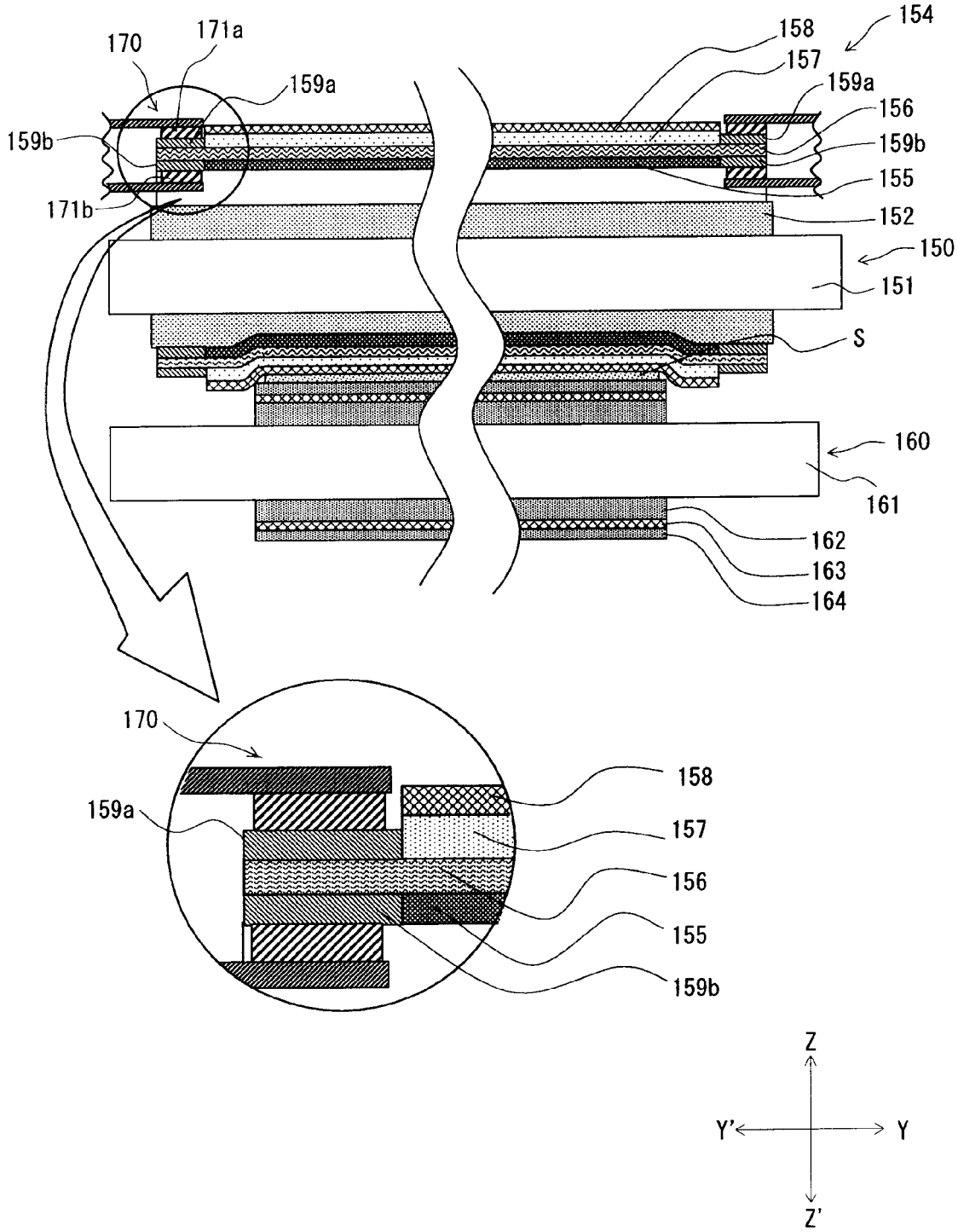
FIG. 4 is an axial sectional view of the fixing device according to the embodiment of the present invention.

FIG. 4 is a sectional view of the fixing device according to the present embodiment, taken along a plane perpendicular to the rotational axis (Y-axis direction) of the pressing roller 160.

The fixing belt 154 is an elastically deformable endless belt having edge portions disposed to flank a middle portion (i.e., the portion other than the edge portions) in the Y-axis direction and the laminated state of the middle portion is different from the edge portions.

More specifically, the fixing belt 154 has two electrode layers 159*a* each laminated on the outer circumferential surface of the resistive heat layer 156 along a different edge of the resistive heat layer 156. The fixing belt 154 also has two electrode layers 159*b* each laminated on the inner circumferential surface of the resistive heat layer 156 along a different edge of the resistive heat layer 156.

In addition, an elastic layer 157 and a releasing layer 158 are laminated in the stated order on a portion of the outer circumferential surface of the resistive heat layer 156 present between the two electrode layers 159*a*, which are disposed along the edges of the resistive heat layer 156.

Similarly, a reinforcing layer 155 is laminated on a portion of the inner circumferential surface of the resistive heat layer 156 present between the two electrode layers 159*b*, which are disposed along edges of the resistive heat layer 156.

The following describes the configuration of the respective layers of the fixing belt 154 in detail.

The reinforcing layer 155 is made of a non-conductive material, such as polyimide (PI), polyphenylenesulfide (PPS) resin, or polyether ether ketone (PEEK), and its thickness is preferably in the range from 5 μm to 200 μm, and in the present example, it is set to 70 μm.

The electrode layers 159*a* and 159*b* are each disposed in contact with one of the power feeder 170 to supply power to the resistive heat layer 156.

More specifically, the electrode layers 159*a* and 159*b* are made, for example, from a material, such as Cu, Ni, Ag, Al, Au, Mg, brass, phosphor bronze, or an alloy of the metals mentioned above. The electrode layers 159*a* and 159*b* are formed by plating, with the material, the inner and outer circumferential surfaces of the resistive heat layer 156 along the respective edges. Alternatively, a conductive ink in which one or more of the above mentioned metals are dispersed may be applied to the inner and outer circumferential surfaces of the resistive heat layer 156 along the respective edges, followed by drying.

The volume resistivity of the electrode layers 159*a* and 159*b* is set to be equal to that of the resistive heat layer 156 or less, and preferably falls within the range of $1.0\times10^{-8}$ Ω·m to $1.0\times10^{-4}$ Ω·m.

Note that the difference between the volume resistivity of the electrode layers 159*a* and 159*b* with the volume resistivity of the resistive heat layer 156 may be relatively small. Even so, by configuring the electrode layers 159*a* and 159*b* to be relatively thicker and the resistive heat layer 156 to be relatively thinner, the electrode layers 159*a* and 159*b* are sufficiently usable as electrodes and the resistive heat layer 156 as a heat generating element.

Preferably, each of the electrode layers 159*a* and 159*b* is 15 mm long in the Y-axis direction and in the range from 1 μm to 100 μm in thickness. In this example, the thickness is 20 μm.

Note, in addition, that the electrode layers 159*a* and 159*b* should not be too thin in order to avoid a voltage drop that would occur before the current injected into the electrode layers 159*a* and 159*b* through portions in contact with the power feeders 170 reaches locations halfway around the outer circumference.

As a result, the electric current in the resistive heat layer 156 would flow only through and near a path defined by connecting the two power feeders 170 with a straight line, which ends up narrowing the heat generating area.

The minimum allowable thickness of each of the electrode layers 159*a* and 159*b* is determined in order to avoid undesirable situations described above.

By applying potential difference across the edges of the resistive heat layer 156 in the Y-axis direction, electric current flows to generate heat due to Joule heating.

More specifically, the resistive heat layer 156 is a 40 μm thick layer formed, for example, by coating a solvent prepared by dispersing, in a polyimide resin used as a base material, one or more conductive fillers mutually different in electrical resistance.

The resistive heat layer 156 is 350 mm long in the Y-axis direction.

Although heat-resistant insulating resins, such as PPS and PEEK, other than PI may be usable as a base material for forming the resistive heat layer 156, PI is preferable as it has the highest heat resistance.

Preferable examples of the conductive fillers include: metals, such as Ag, Cu, Al, Mg and Ni; carbon-based powder materials, such as carbon nanotube and carbon nanofiber; and high-ion conductive powder materials, such as silver iodide and copper iodide, present in inorganic compounds.

Preferably, the electrically conductive fillers are in a fibrous state to ensure that the conductive fillers to make more contact per unit content and the base material permeates into the conductive fillers more easily.

Among the above-mentioned constituents of conductive fillers, each metal has a positive temperature coefficient (PTC) so that the volume resistance of the metal increases with an increase in temperature. On the other hand, each carbon-based powder material and high-ion conductive powder material has a negative temperature coefficient (NTC) so that the volume resistance of the powder decreases with a decrease in temperature. By mixing those constituents having opposite properties at an appropriate ratio, the resulting fillers exhibit a desired volume resistance.

Note that the base material may additionally include a filler other than those mentioned above, in order to improve the mechanical strength and/or thermal conductivity of the resistive heat layer 156.

On condition that the power supply 180 is a commercial power supply as mentioned above, the volume resistance preferably falls within the range from $1.0\times10^{-6}$ to $1.0\times10^{-2}$ Ω·m in order to achieve an intended heating value. More preferably, in view of the configuration of the fixing unit 5 according to the present embodiment, the volume resistance preferably falls within the range from $1.0\times10^{-5}$ to $5.0\times10^{-3}$ Ω·m.

The elastic layer 157 is made from, for example, an elastic and heat-resisting material such as silicone rubber and about 200 μm thick.

Alternatively to the silicone rubber, the elastic layer 157 may be made from, for example, a fluorine-containing rubber.

The releasing layer 158 is made from a material having releasability, typified by a fluorine-containing resin, such as PTFE or PFA, and its thickness is in the range from 5 μm to 100 μm.

As described above, the fixing unit 5 according to the embodiment has a pair of electrode layers 159*a* and 159*b* along an edge of the resistive heat layer 156 and another pair of electrode layers 159*a* and 159*b* along the other edge of the resistive heat layer 156. In each pair, the electrode layer 159*a* is disposed on the outer circumferential surface of the resistive heat layer 156, whereas the electrode layer 159*b* is disposed on the inner circumferential surface of the resistive heat layer 156. In addition, the fixing belt 5 is provided with the power feeders 170 each in contact with a different pair of the electrode layers 159*a* and 159*b* to supply power thereto.

<Confirmation of Improved Temperature Distribution>

According to a conventional configuration, electrode layers are disposed only on either of the inner or outer circumferential surface of a resistive heat layer and along the respective edges of the resistive heat layer. In contrast, the fixing belt according to the present embodiment has two pairs of electrode layers 159*a* and 159*b* and each pair is located along a different edge of the resistive heat layer 156. In each pair, the electrode layers 159*a* and 159*b* are disposed on the outer and inner circumferential surfaces of the resistive heat layer 156, respectively.

Figure 5A:
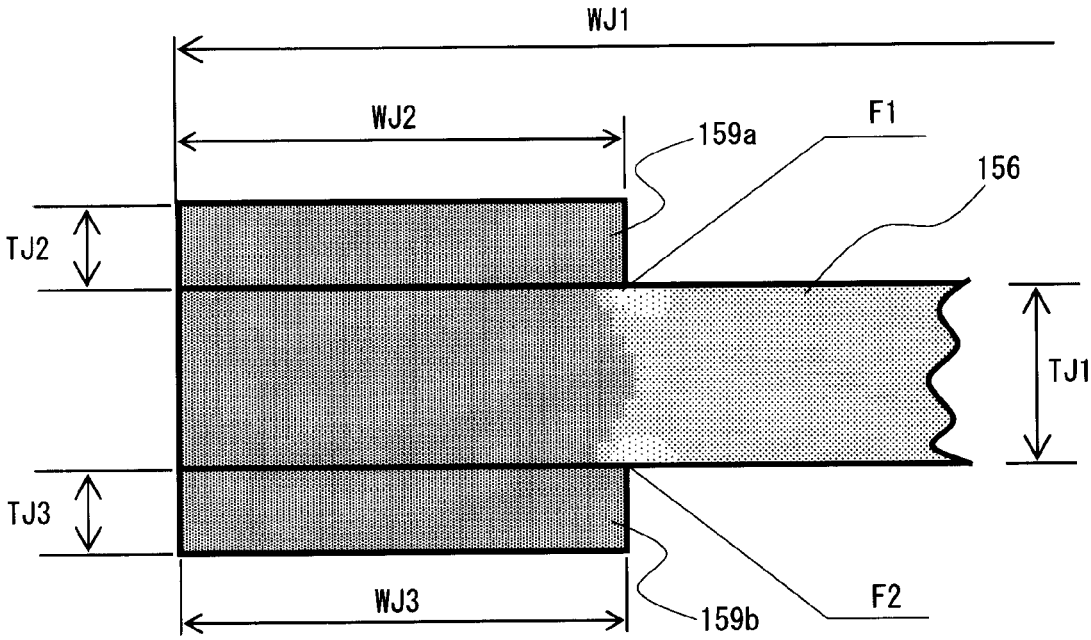
FIGS. 5A and 5B are views illustrating the temperature reduction achieved at overheating portions of a fixing belt according to the embodiment of the present invention.

FIG. 5A is a view of an edge portion (Y'-axis edge portion) of the fixing belt 154 included in the fixing unit 5 configured as described above according to the embodiment, to show a simulated temperature distribution across the electrode layers 159*a* and 159*b* and the resistive heat layer 156.

Figure 5B:
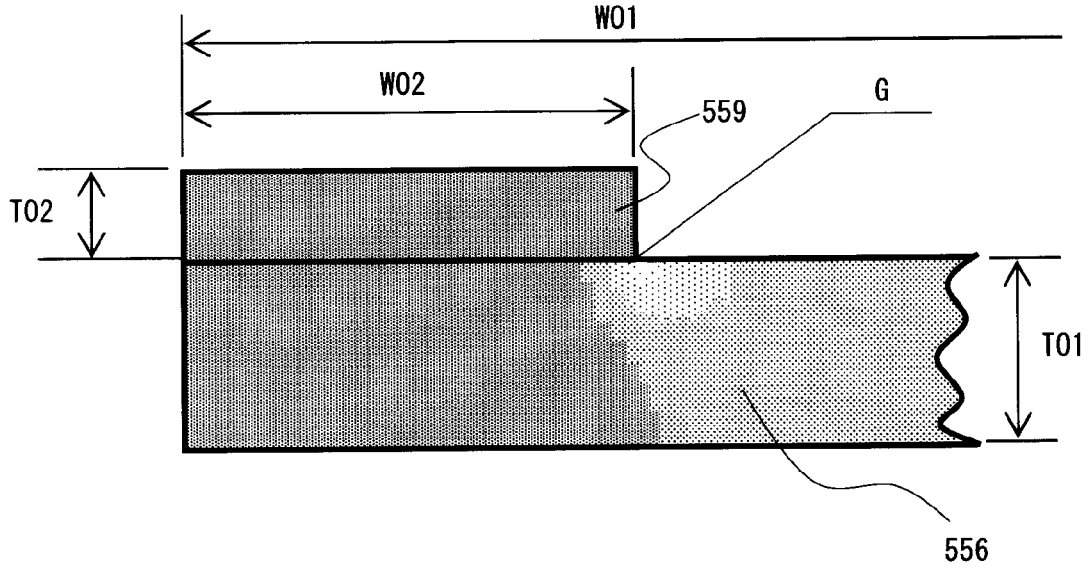

FIG. 5B is a view of an edge portion (Y'-axis edge portion) of the conventional fixing belt 500, to show a simulated temperature distribution across the electrode layer 559 and the resistive heat layer 556.

In the simulation, a model containing only the electrode layers 159*a* and 159*b* and the resistive heat layer 156, which directly contributes to heat generation, is used.

In the figure, darker colors represent lower temperatures, whereas lighter colors represent higher temperatures.

<Simulation Conditions>

Volume resistivity of resistive heat layer: $9.4\times10^{-5}$ Ω·m

Applied voltage: 100 V

Volume resistivity of electrode: $1.72\times10^{-8}$ Ω·m

The simulation conditions other than those mentioned above are the same as the fixing belt 154 according to the present embodiment.

<Dimensions>

The dimensions of the portions denoted by the following reference signs in FIGS. 5A and 5B are as follows.

Present Embodiment

WJ1: 340 mm (width in Y-axis direction)

WJ2: 15 mm

TJ1: 40 μm

TJ2: 20 μm

TJ3: 20 μm

Conventional Product

WO1: 340 mm (width in Y-axis direction)

WO2: 15 mm

TO1: 40 μm

TO2: 20 μm

As shown in FIG. 5B relating to the conventional product, the temperature of the resistive heat layer 556 is highest along where a ring contact is made with the annular edge G of the electrode layer 559 closer toward the center of the fixing belt.

More specifically, the temperature of the resistive heat layer 556 is 164° C. along the annular edge G and in the range ambient to 148° C. at middle portion located between the two annular edges G (only one of the annular edges G is shown in the figure). That is, there is a large temperature difference of 16° C.

In contrast, as shown in FIG. 5A relating to the present embodiment, the temperature of the resistive heat layer 156 is highest at annular edge F1 and F2, which correspond to the annular edge G mentioned above. Yet, the highest temperature is lower as compared with the annular edge G of the conventional product.

More specifically, the temperature of the resistive heat layer 156 is 159° C. at the annular edge F1 and F2, and 150° C. at the middle portion along the Y-axis direction. That is, the temperature difference with the highest portion is 9° C., which indicates that the temperature is more uniform across the resistive heat layer 156 as compared with the conventional product.

The following is assumed to be the reason for this phenomenon.

That is, in the conventional product, the current flows from the electrode layer 559 to the resistive heat layer 556 mainly through where the annular edge G of the electrode layer 559 contacts the resistive heat layer 556, which leads to increase the current density and thus increase the temperature at a portion in contact with the annular edge G of the electrode layer 559.

It is because electric current tends to flow along paths of least electrical resistance. Regarding the current flowing between the electrode layer 559 and the resistive heat layer 556, the electrical resistance is smaller in a path through the annular edge G of the electrode layer 559 than through the portion where the electrode layer 559 makes surface contact with the resistive heat layer 556 (i.e., without passing through the annular edge G). Therefore, despite the surface contact between the electrode layer 559 and the resistive heat layer 556, the current flow between the electrode layer 559 and the resistive heat layer 556 takes place mostly through the annular edge G Turning now to the fixing belt 154 according to the present embodiment, along each edge of the resistive heat layer 156, the electrode layers 159*a* and 159*b* are disposed on the outer and inner circumferential surfaces of the resistive heat layer 156, respectively.

For the same reason as described in relation to the conventional product, the electric current between each electrode layer and the resistive heat layer 156 tends to flow only through a portion near annular edge F1 and F3 of the electrode layers 159*a* and 159*b*, despite the surface contact between each the electrode layers 159*a* and 159 and the resistive heat layer 156.

That is, in the conventional product, the electric current flowing into the resistive heat layer 556 concentrates at a portion of the resistive heat layer 556 near the annular edge G of the electrode. In contrast, the fixing belt 154 according to the present embodiment ensures that the electric current concentrates at two locations in the resistive heat layer 156, namely, portions near the annular edge F1 and F2 of the electrode layers 159*a* and 159*b*.

As a result, the current density is decreased and thus the risk of local heating is reduced, which is effective to extend the life of the fixing belt 154.

Figure 6:
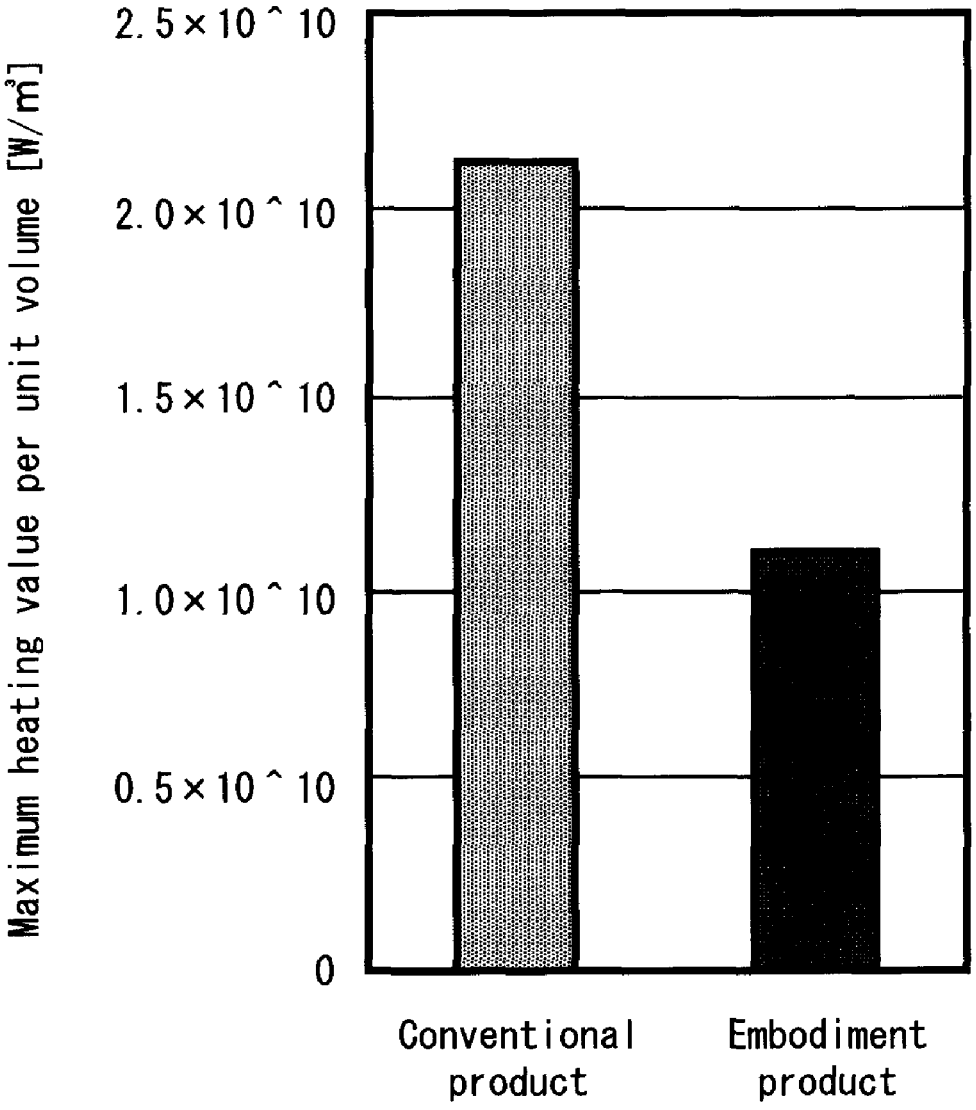
FIG. 6 is a graph of the temperature reduction achieved at overheating portions of the fixing belt according to the embodiment of the present invention.

FIG. 6 is a graph of the simulated maximum heating values per unit volume of the respective resistive heat layers according to the conventional product and the present embodiment.

As shown in the figure, the maximum heating value per unit volume exhibited by the product of the present embodiment is only ½ of the conventional product.

Normally, the fusing temperature is set to fall within the range ambient to 160° C., and the heat-resistant temperature required for the fixing belt 154 is up to 240° C.

Therefore, it is required that the highest temperature measured at any location within the fixing belt 154 be 240° C. or lower.

In addition, the life of the fixing belt 154 is expected to be shorter at portions where temperatures are higher. Then, there is a risk of cracks running from a location having reached the end of its useful life.

In order to prevent such undesirable situations, it is required that the highest temperature at overheating portions of the fixing belt 154 be maintained as low as possible.

The fixing belt 154 according to the present embodiment is configured such that the highest temperature measured at any location within the fixing belt 154 is 240° C. or lower and that the temperature of the portions subject to most severe overheating is lower. Therefore, the present embodiment extends the life of the fixing belt and prevents or at least reduces thermal deformation.

<Modifications>

The present invention is not limited to the specific embodiment described above and various modifications including the following may be made.

(1) According to the embodiment described above, the fixing belt 154 includes the reinforcing layer 155, the resistive heat layer 156, the elastic layer 157, the releasing layer 158, and the electrode layers 159*a* and 159*b*. However, this description is given merely by way of example and without limitation. It is sufficient that the fixing belt at least includes the resistive heat layer 156 and the electrode layers 159*a* and 159*b*.

For example, in the case of a monochrome copier, the fixing nip may be smaller in width without adversely affecting the fixing quality much, as compared with the case of a color copier. For this reason, the fixing belt 154 for a monochrome copier may be configured without the elastic layer 157.

(2) According to the embodiment described above, in each pair of electrode layers located along an edge of the resistive heat layer 156, the electrode layer 159*a* and the electrode layer 159*b* disposed on the outer and inner circumferential surface of the resistive heat layer 156 are separate layers. However, this description is given merely by way of example and without limitation.

Figure 7:
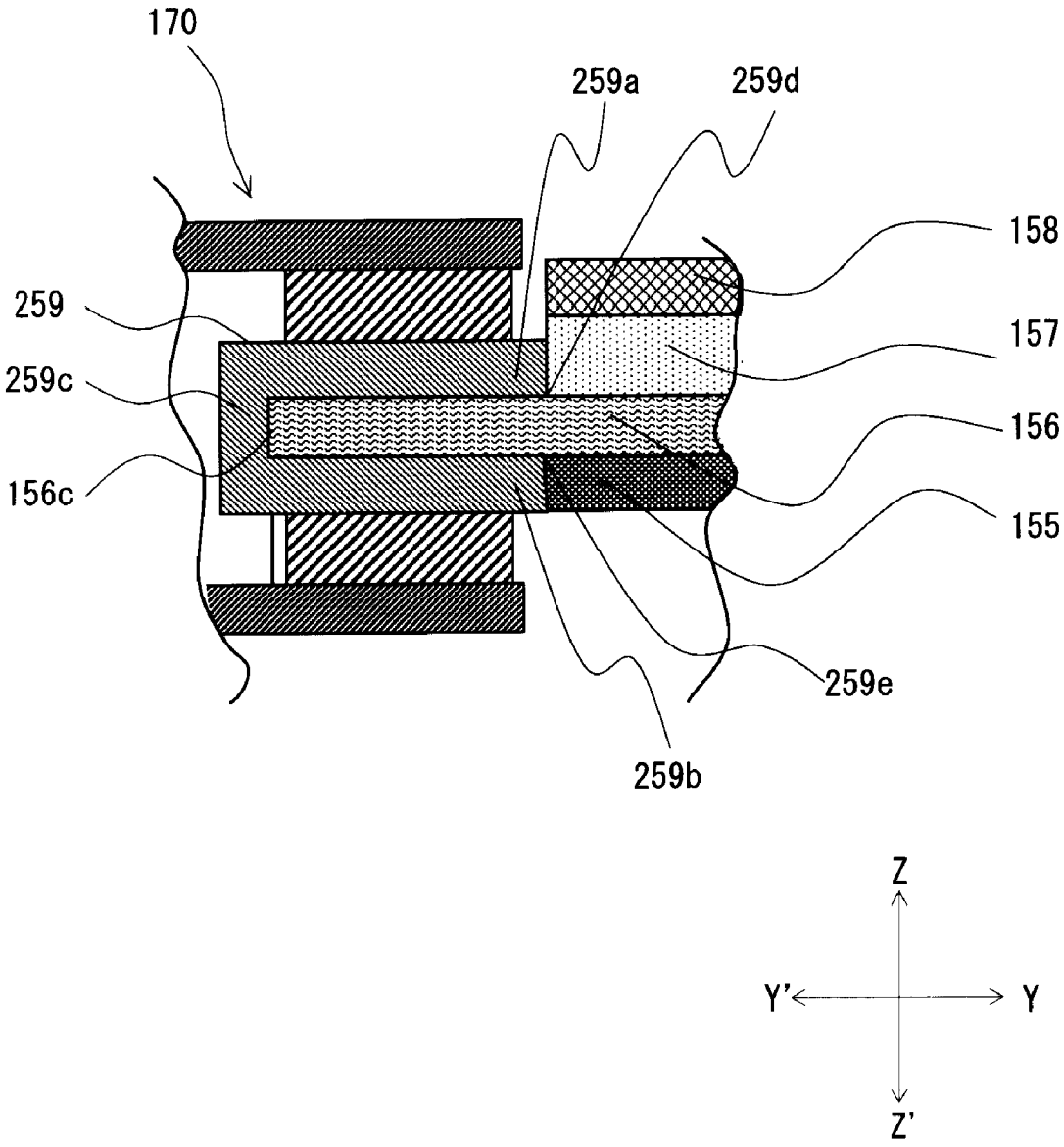
FIG. 7 is a view of a fixing device according to a modification of the present invention.

In one modification shown in FIG. 7, an electrode 259 composed of two electrode portions 259*a* and 259*b* (which correspond to the electrode layers 159*a* and 159*b*) and a bottom portion 259*c* and the portions 259*a*, 259*b* and 259*c* are continuous to define a squared U shape in cross section. Such an electrode 259 may be disposed at one or both of the edges of the resistive heat layer 156.

In other words, along at least one of the edges of the resistive heat layer 156, the electrode layers 159*a* and 159*b* are formed as a continuous layer that is in contact with the inner circumferential surface, the end face, and the outer circumferential surface of the resistive heat layer 156.

Even in this modification, the electric current flows into the resistive heat layer 156 mainly from two portions of the electrode 259, namely peripheral edges 259*d* and 259*e* of the electrode portions 259*a* and 259*b* and closer toward the resistive heat layer 156, despite that the bottom portion 259*c* of the electrode 259 is in contact with an end face 156*c* of the resistive heat layer 156. Since the peripheral edges 259*a* and 259*b* of the electrode 159 are relatively away from the end face 156*c* of the resistive heat layer 156, little current flows through the end face 156*c*. Thus, the description of the current flow regarding the fixing belt 154 according to the above embodiment is applicable to this modification.

Thus, with the electrode 259 having the configuration described above, the resulting fixing belt achieves to alleviate local overheating, similarly to the fixing belt 154.

Note, in addition, that both the electrode portions 259*a* and 259*b* may be disposed in contact with the power feeder 170 as shown in FIG. 7. Alternatively, only one of the electrode portions 259*a* and 259*b* may be disposed in contact with the power feeder 170.

The above alternative is possible for the following reason. That is, the electrode 259 has a smaller volume resistivity than the resistive heat layer 156. Consequently, even if the power feeder 170 is in contact with only one of the electrode portions 259*a* and 259*b*, the electric current fed into the electrode portion 259*a* or 259*b* flows into the other one of the electrode portions 259*a* and 259*b* via the bottom portion 259*c*.

(3) In the above embodiment, the power feeds 170 push the block-shaped brushes 171*a* and 171*b* against the electrode layers 159*a* and 159*b* of the fixing belt 154. However, this description is given merely by way of example and without limitation.

Figure 8:
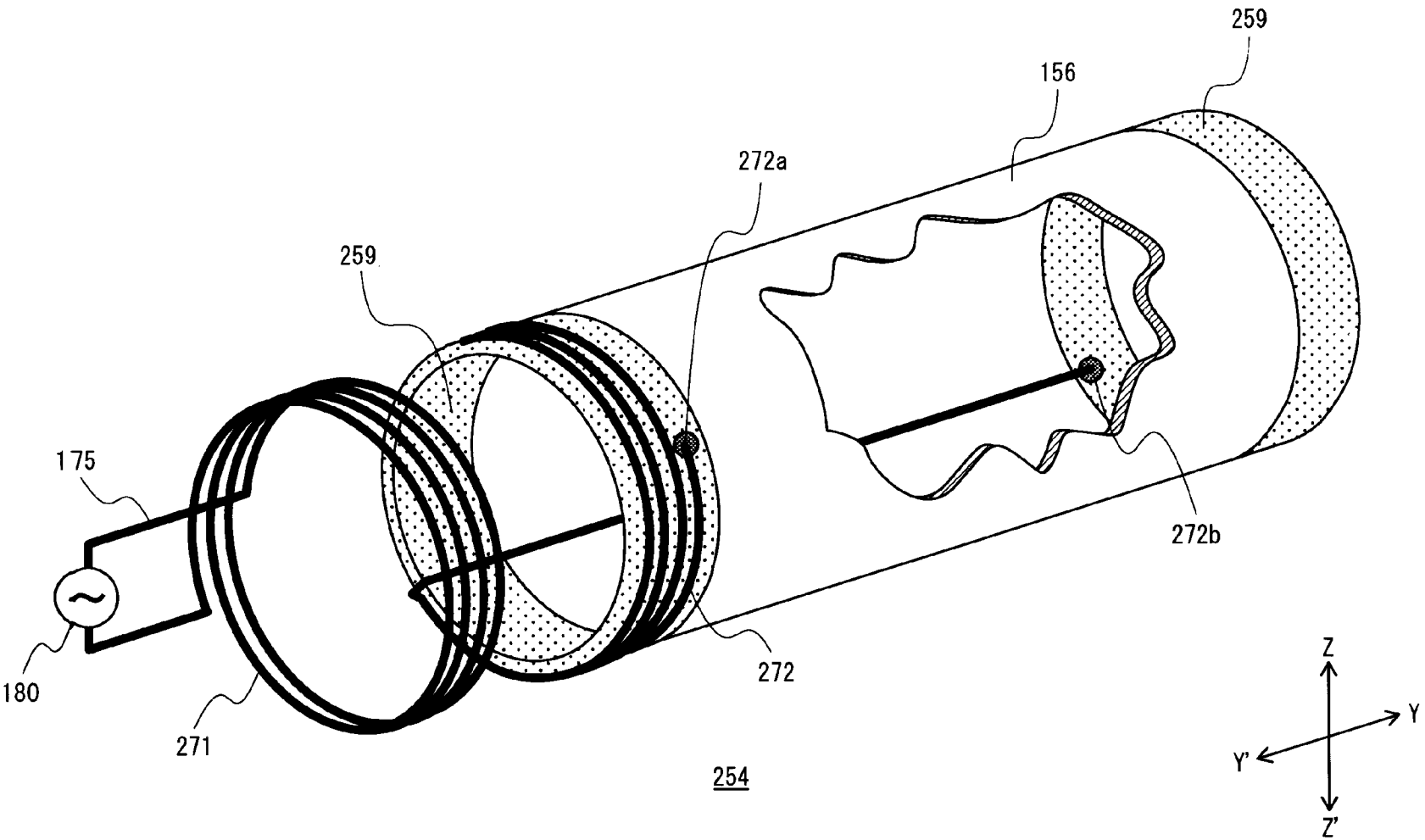
FIG. 8 is a view of a fixing device according to another modification of the present invention.
Figure 9:
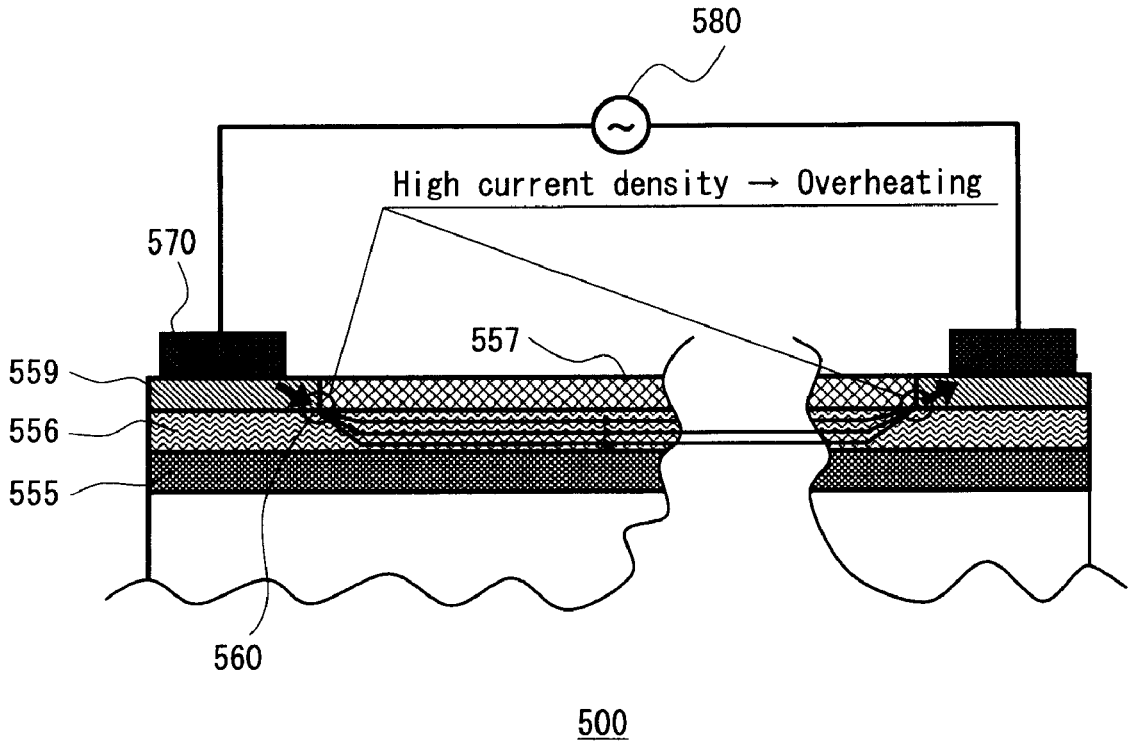
FIG. 9 Prior Art
FIG. 9 is a sectional view of a conventional fixing belt.

For example, the fixing belt shown in FIG. 7 may be further modified as shown in FIG. 8. In this modification, a primary coil 271 connected to the power supply 180 is disposed in the main frame of the fixing device. In addition, a secondary coil 272 is disposed in the fixing belt 254. One of the tip portions of the secondary coil 272 is coated with an insulating material. One of the tip portions of the secondary coil 272, namely tip portion 272*a*, is electrically connected to one of the electrodes 259 that is located toward the Y' direction. In addition, the other tip portion 272*b* of the secondary coil 272 is electrically connected to the other one of the electrodes 259 that is located toward the Y direction. The primary coil 271 and the secondary coil 272 are then disposed to oppose each other and an AC current is supplied to the primary coil 271 to induce electric current in the secondary coil 272. In this way, electric current may be supplied to the electrode 259 in a non-contact manner.

In another modification, a pair of metal rollers may be used instead of the brushes 171*a* and 171*b*. By sandwiching an edge of the fixing belt 154 between the pair of metal rollers, the electrode layers 159*a* and 159*b* are maintained in electrical contact while reducing friction against rotation of the fixing belt.

(4) According to the embodiment described above, the electrode layers 159*a* and 159*b* are formed along the edges of the resistive heat layer 156 opposed to each other in the Y-axis direction. However, this description is given merely by way of example and without limitation.

That is, the two electrode layers 159*a* may be provided on the outer circumferential surface of the resistive heat layer 156 at any locations flanking the sheet passing area in the Y-axis direction. Similarly, the two electrode layers 159*b* may be provided on the inner circumferential surface of the resistive heat layer 156 at any locations flanking, in the Y-axis direction, an area of the inner circumferential surface corresponding to the sheet passing area.

In addition, the electrode layers 159*a* and 159*b* disposed along the same edge of the resistive heat layer 156 may be deviated to some extent from each other in the Y-axis direction In this modification, it is preferable that the relative position of the brushes 171*a* and 171*b* of a corresponding one of the power feeder 170 be deviated accordingly to the deviation amount between the electrode layers 159*a* and 159*b*.

(5) In the above embodiment, the pressure roller 150 is disposed inside the running path of the fixing belt 154 with play relatively to the fixing belt 154. Alternatively, however, the pressure roller 150 may be disposed without play.

In addition, a fixing roller may be employed in which the pressure roller 150 and the fixing belt 154 are integrated.

More specifically, the outer circumferential surface of the roller shaft may be covered with a roller cover made with a laminate of an elastic layer, a resistive heat layer, an electrode layer, a releasing layer, and so on.

Alternatively, the fixing belt 154 may be wound around first and second rollers in taut condition.

In this modification, the first roller may be a pressure roller that cooperates with the pressing roller to form a fixing nip, whereas the second roller may be a roller for setting the length of the fixing belt 154.

With the above configuration, a reduction in outer diameter of the pressure roller improves the releasability of recording sheets. In addition, an increase in the length of the fixing belt 154 reduces the number of rotation per unit time, which leads to the reduction of friction and thus to a longer life of the fixing belt 154.

(6) According to the above embodiment, a material having PTC and a material having NTC are mixed at an appropriate ratio to obtain conducive fillers to exhibit a desired volume resistance. In addition, the ratio may be adjusted for any other purpose.

For example, consider the case where a number of small-size recording sheets are successively printed. In this case, the temperature of the fixing belt 154 tends to be higher at the edge portions where no recording sheets pass (sheet non-passing areas) because no heat is transferred to such recording sheets. In view of this, a fixing belt may be configured with conductive fillers having high content NTC content at the edge portions, so that the temperature rise at sheet non-passing areas is reduced.

Generally, the sheet non-passing areas are located in contact with or near an electrode layer. Therefore, the current density locally increases at portions near the boundary between the electrode layer and the resistive heat layer to raise the temperature. Consequently, the volume resistivity decreases, which leads to an effect of reducing the heating.

The fixing belt 154 according to the above embodiment is configured not to cause an increase in current density at the boundary portions. Therefore, the heating at the boundary portions are duly suppressed, without requiring that the sheet non-passing areas be high in content of conductive filler with a high NTC content.

(7) According to the present embodiment, the electrode layers 159*a* and 159*b* are each in an annular form that surrounds the fixing belt 154 in a circumferential direction. However, this description is given merely by way of example and without limitation. For example, each of the electrode layers 159*a* and 159*b* may have at least one slit non-orthogonal or in parallel to the axis of the pressure roller 150.

In this modification, the locations of the power feeder 170 or the number of slits provided may be optimized to heat only part of the fixing belt 154 relevant to the formation of the fixing nip N, which leads to power savings.

(8) According to the above embodiment, the components, namely the pressure roller 150 and the pressing roller 160, that are disposed to sandwich the fixing belt 154 to form a fixing nip are both rotatable bodies. Alternatively, however, only one of the components may be a rotatable body and the other component may be a non-rotatable, fixed body as long as the other component cooperates with the rotatable body to apply pressure to the fixing belt 154.

One example of such a member is a member of long dimension in a direction perpendicular to the running direction of the fixing belt 154 having a highly smooth surface.

In short, any member, such as a rotatable body or a fixed member of long dimension, is usable as long as the member is usable to apply pressure.

(9) The above embodiment is directed to an example in which the image forming apparatus according to the present invention is applied to a tandem-type digital color printer. However, this description is given merely by way of example and without limitation. The present invention is generally applicable to a fixing device having a pressure member, such as a pressure roller, disposed inside the running path of the fixing belt and a pressing roller pressing the pressure member via the fixing belt, whereby a fixing nip is formed. The present invention is also applicable generally to an image forming apparatus having such a fixing device.

In addition, any combination of the above embodiment and modifications still falls within the scope of the present invention.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device for thermally fixing an unfixed image formed on a recording sheet by passing the recording sheet through a fixing nip, the fixing device comprising:

a heat-generating endless belt having, on a circumferential surface thereof, a sheet passing area through which the recording sheet passes;

a first pressure member disposed inside a running path of the heat-generating endless belt;

a second pressure member disposed to press the heat-generating endless belt against the first pressure member from outside the running path to form the fixing nip, and a pair of power feeders, wherein the heat-generating endless belt includes:

a circumferential resistive heat layer that generates heat upon having electric current applied thereto; and a first electrode and a second electrode that receive electric current, the first and second electrodes flanking the sheet passing area, each of the first and second electrodes is composed of a pair of electrode layers, one disposed on an inner circumferential surface of the resistive heat layer and another disposed on an outer circumferential surface of the resistive heat layer, and one of the power feeders is disposed in contact with both the electrode layers of the first electrode to feed power thereto, and another one of the power feeders is disposed in contact with both the electrode layers of the second electrode to feed power thereto.

2. The fixing device according to claim 1, wherein the electrode layers of at least one of the first and second electrodes together comprise a continuous layer that is in contact with the inner circumferential surface, an end face, and the outer circumferential surface of the resistive heat layer.

3. The fixing device according to claim 1, wherein the first pressure member is a cylindrical pressure roller, the heat-generating endless belt is fit with clearance about the first pressure member, and the first pressure member and the heat-generating endless belt rotate following rotation of the second pressure member.

4. The fixing device according to claim 1, wherein the first pressure member is a cylindrical roller shaft, the heat-generating endless belt is a roller cover disposed on an outer circumferential surface of the roller shaft, and the roller shaft and the roller cover together comprise a single roller.

5. The fixing device according to claim 1, wherein the resistive heat layer is made of a heat-resistant insulating resin containing a conductive filler dispersed therein.

6. An image forming apparatus including a fixing device for thermally fixing an unfixed image formed on a recording sheet by passing the recording sheet through a fixing nip, the fixing device comprising:

a heat-generating endless belt having, on a circumferential surface thereof, a sheet passing area through which the recording sheet passes;

a first pressure member disposed inside a running path of the heat-generating endless belt;

a second pressure member disposed to press the heat-generating endless belt against the first pressure member from outside the running path to form the fixing nip, and a pair of power feeders, wherein the heat-generating endless belt includes:

a circumferential resistive heat layer that generates heat upon having electric current applied thereto; and a first electrode and a second electrode that receive electric current, the first and second electrodes flanking the sheet passing area, each of the first and second electrodes is composed of a pair of electrode layers, one disposed on an inner circumferential surface of the resistive heat layer and another disposed on an outer circumferential surface of the resistive heat layer, and one of the power feeders is disposed in contact with both the electrode layers of the first electrode to feed power thereto, and another one of the power feeders is disposed in contact with both the electrode layers of the second electrode to feed power thereto.

7. The image forming apparatus according to claim 6, wherein the electrode layers of at least one of the first and second electrodes together comprise a continuous layer that is in contact with the inner circumferential surface, an end face, and the outer circumferential surface of the resistive heat layer.

8. The image forming apparatus according to claim 6, wherein the first pressure member is a cylindrical pressure roller, the heat-generating endless belt is fit with clearance about the first pressure member, and the first pressure member and the heat-generating endless belt rotate following rotation of the second pressure member.

9. The image forming apparatus according to claim 6, wherein the first pressure member is a cylindrical roller shaft, the heat-generating endless belt is a roller cover disposed on an outer circumferential surface of the roller shaft, and the roller shaft and the roller cover together comprise a single roller.

10. The image forming apparatus according to claim 6, wherein the resistive heat layer is made of a heat-resistant insulating resin containing a conductive filler dispersed therein.

* * * * *